US006256998B1

(12) United States Patent
Gao

(10) Patent No.: US 6,256,998 B1
(45) Date of Patent: Jul. 10, 2001

(54) HYBRID-TWO-STAGE PULSE TUBE REFRIGERATOR

(75) Inventor: Jin Lin Gao, Wescosville, PA (US)

(73) Assignee: IGCAPD Cryogenics, Inc., Allentown, PA (US)

( * ) Notice: Subject to any disclaimer, the term of this patent is extended or adjusted under 35 U.S.C. 154(b) by 0 days.

(21) Appl. No.: 09/556,552

(22) Filed: Apr. 24, 2000

(51) Int. Cl.[7] ..... F25B 9/00

(52) U.S. Cl. ..... 62/6

(58) Field of Search ..... 62/6; 60/520

(56) References Cited

U.S. PATENT DOCUMENTS 3,237,421 3/1966 Gifford .
4,953,366 9/1990 Swift et al. .
5,107,683 4/1992 Chan et al. .

(List continued on next page.)

OTHER PUBLICATIONS

Cryogenics 1994, vol. 34, No. 1, pp. 25–30, Experimental Investigation of 4 K Pulse Tube Refrigerator, J.L. Gao et al.
Cryogenics 1994, vol. 34 ICEC Supplement 1994, pp. 155–158, Multi–staged Pulse Tube Refrigerator for Superconducting Magnet Applications, Y. Matsubara et al.
Aaron Bitterman & Steve Brody; Pulse Tubes Gain Foothold in Cryocooler Markets; Superconductor & Cryoelectronics—Spring 1998; pp. 12–18.
Shaowei Zhu et al.; Investigation of Active–Buffer Pulse Tube Refrigerator; Sakai Laboratories, Daido Hoxan Inc., Jan. 13, 1997; Cryogenics 1997, vol. 37, No. 8, pp. 461–471.
C. Wang, et al.; Two–Stage Pulse Tube Cooler Operating Below 4K; Institute of Applied Physics, University of Giessen, Oct. 22, 1996; Cryogenics 1997, vol. 37, No. 3, pp. 159–164.
G. Kaiser, et al.; Thermodynamic Analysis of an Ideal Four–Valve Pulse Tube Refrigerator; Institu für Festkörperphysik, Jan. 9, 1996; Cryogenics 36 (1996) 527–533.
Shaowei Zhu, et al.; The Double Inlet Work Loss in Double Inlet Pulse Tube Refrigerators; Proceedings of the Fifth Japanese–Sino Joint Seminar on Cryocooler and Its Applications JSJS–5; Sep. 16–20, 1997.
Sixteenth International Cryogenic Engineering Conference; International Cryogenic Materials Conference; ICEC 16/ICMC; Elsevier Science, pp. 33–44.
J. Yuan et al.; Thermodynamic Analysis of Active Valve Pulse Tube Refrigerators; Applied Superconductivity Center; Nov. 17, 1998; Cryogenics 39 (1999) pp. 283–292.
Shao Wei Zhu, et al.; Active–Buffer Pulse–Tube Refrigerator; "Proceedings of ICEC 16" Kitakyushu, Japan, 20–24, May 1996; Elsevier Science 1997; pp. 291–294.
Y. Matsubara, Four–Valve Pulse Tube Refrigerator; "Proceedings of JSJS–4" Beijing, China, Oct. 19–21, 1993; pp. 54–58.
J. Yuan et al.; A Single Stage Five Valve Pulse Tube Refrigerator Reaching 32 K; Advances in Cryogenics Engineering—vol. 43, p 1983, Edited by P. Kittel, Plemum Press, New York 1998.

*Primary Examiner*—William Doerrler
(74) *Attorney, Agent, or Firm*—Helfgott & Karas, P.C.

(57) ABSTRACT

A two-stage pulse tube refrigerator comprises a pressure wave generator-compressor, first stage and second stage regenerators, first stage and second stage pulse tubes, heat exchangers and a hybrid phase shift mechanism for the first and second stage pulse tubes. The second stage phase shift mechanism includes double fixed orifices while the first stage shifter is an arrangement including one of a) 4 valves, b) 5 valves c) 2 active buffers or d) 3 active buffers. The double fixed orifice phase shifter is located either at room temperature or is thermally connected with the first stage cold end. Two-stage pulse tube refrigerators with a hybrid phase shifter have increased second stage regenerator performance at lower temperature. Pressure drop through the valves and compressor power consumption are decreased, and losses from phase interaction between each stage are eliminated.

24 Claims, 11 Drawing Sheets

U.S. PATENT DOCUMENTS

| | | | | |
|---|---|---|---|---|
| 5,295,355 | | 3/1994 | Zhou et al. . | |
| 5,335,505 | | 8/1994 | Ohtani et al. . | |
| 5,412,952 | | 5/1995 | Ohtani et al. . | |
| 5,515,685 | | 5/1996 | Yanai et al. . | |
| 5,647,218 | | 7/1997 | Kuriyama et al. . | |
| 5,711,156 | | 1/1998 | Matsui et al. . | |
| 5,744,959 | | 4/1998 | Jeker et al. . | |
| 5,845,498 | * | 12/1998 | Matsui et al. | 62/6 |
| 5,966,944 | | 10/1999 | Inoue et al. . | |
| 5,974,807 | | 11/1999 | Gao et al. . | |

* cited by examiner

HYBRID-TWO-STAGE PULSE TUBE REFRIGERATOR

BACKGROUND OF THE INVENTION

Pulse tube refrigeration without moving parts, operating at cryogenic temperature, is one attractive method for providing a reliable, vibration-free, long life, and simple cryocooler that can meet the requirements for cryogenic cooling in many applications. In order to produce cooling effect at a pulse tube cold end, it is necessary to cause a time-phasing [shifting] between gas pressure fluctuations and gas displacement inside the pulse tube. Such phase shift between the gas pressure fluctuation and the gas displacement inside the pulse tube is obtained by controlling the mass flow rate with a phase shifter located at the pulse tube warm end.

Several types of phase shifters have been developed for improvement in performance of the pulse tube refrigerator, such as double inlet, four valve, and active buffer type phase shifters. However, there are several disadvantages in present phase shifters for multiple stage pulse tube refrigerators.

In the double inlet type and four valve pulse tube refrigerator for producing large cooling capacity at relatively high temperature, a large amount of additional compressor work is expended due to mass flow in and out of a bypass line and valves. This added workload decreases overall efficiency of the machine. In multiple stage double inlet and four valve pulse tube refrigerators, phase interaction between each stage produces thermal losses and makes the refrigeration temperature unstable at each stage.

In the active buffer type pulse tube refrigerator producing small cooling capacity at very low temperature, regenerator inefficiency is very high due to larger mass flow rate through the regenerator cold end and poor phase shift effect at a higher ratio of regenerator void volume to pulse tube volume.

SUMMARY OF THE INVENTION

The present invention addresses these problems in the conventional pulse tube refrigerators. An objective of the present invention is to provide an improved two-stage pulse tube refrigerator which has higher overall efficiency at a higher temperature stage, and higher regenerator performance at a lower temperature stage, and less phase interaction losses.

In order to meet the above and other objectives, a two-stage pulse tube refrigerator in accordance with the invention comprises a pressure wave generator-compressor, first stage and second stage regenerators, first stage and second stage pulse tubes, heat exchangers, and a hybrid phase shift mechanism for the first and second stage pulse tubes. The second stage phase shift mechanism utilizes at least one fixed orifice. The fixed orifice phase shifter is either located at room temperature or thermally connected with the first stage cold end. The first stage phase shifter includes any one of a) 4 valves, b) 5 valves, c) 2 active buffers, or d) 3 active buffers.

In a pulse tube refrigerator with two active phase shifting valves, the valves are positioned at room temperature between the warm end of the first stage pulse tube and the compressor return and supply line. One orifice is positioned at room temperature between the warm end of the second stage pulse tube and one buffer where there is a moderate gas pressure. Another orifice is positioned at room temperature between the warm end of the first regenerator and the warm end of the second stage pulse tube.

In another pulse tube refrigerator with three active valves, the valves are positioned at room temperature between the warm end of the first stage pulse tube and the compressor return and supply line, and one active valve is positioned between the warm end of the first stage pulse tube and one buffer. One orifice is positioned at room temperature between the warm end of the second stage pulse tube and one buffer where there is a moderate gas pressure. Another orifice is positioned at room temperature between the warm end of the first regenerator and the warm end of the second stage pulse tube.

Still another pulse tube refrigerator has a hybrid phase shift mechanism with three buffers, three active valves and two orifices. The three active valves are positioned at room temperature between three buffers and the warm end of the first stage pulse tube. One orifice is positioned at room temperature between the warm end of the second stage pulse tube and one buffer where there is a moderate gas pressure. Another orifice is positioned at room temperature between the warm end of the first regenerator and the warm end of the second stage pulse tube.

A fourth embodiment of a pulse tube refrigerator in accordance with the invention has a double fixed orifice phase shifter for a second stage thermally connected with the first stage cold end. The warm end of the second stage pulse tube is thermally connected with the first stage cold end. One orifice is positioned between the first stage cold end and the second stage pulse tube warm end, and another orifice is positioned between the warm end of the second stage pulse tube and one buffer at the first stage cold end.

BRIEF DESCRIPTION OF THE DRAWINGS

For a full understanding of the invention reference is had to the following description taken in connection with the accompanying drawings, in which.

DESCRIPTION OF PREFERRED EMBODIMENTS

Figure 1:
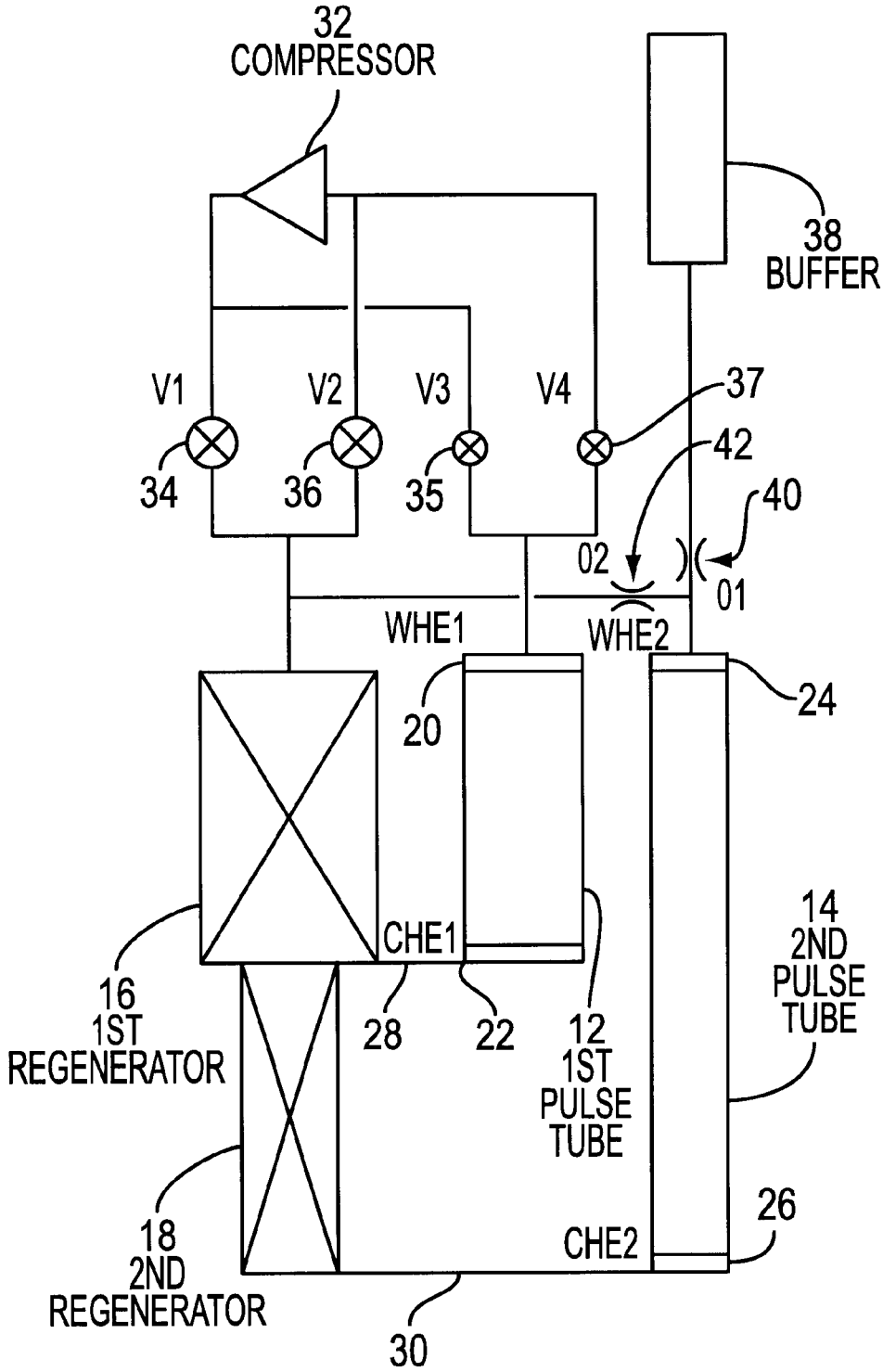
FIG. 1 is a schematic diagram of a two-stage pulse tube refrigerator in accordance with the invention.

With reference to the Figures, a two-stage pulse tube refrigerator in accordance with the invention includes a first pulse tube 12 and a second pulse tube 14, a first regenerator 16 connected to a second regenerator 18. The first pulse tube 12 has a warm end heat exchanger 20 and a cold end and heat exchanger 22, and the second pulse tube 14 has respective warm and cold end heat exchangers 24, 26.

A line 28 connects between the cold end heat exchanger 22 of the first pulse tube 12 and the colder end of the first regenerator and warmer end of the second regenerator 18. A line 30 connects between the cold end heat exchanger 26 of the second pulse tube 14 and the cold end of the second regenerator 18. The warm end of the first regenerator 16 connects to the low pressure side of a compressor 32 by way of the on/off valve 36, and, the warm end heat exchanger 20 of the first pulse tube 12 also connects to the low pressure inlet of the compressor 32 by way of the on/off valve 37. The high pressure discharge of the compressor 32 connects with the warm end of the first regenerator 16 by way of the valve 34 and to the warm end heat exchanger 20 in the first pulse tube 12 by way of the valve 35.

A buffer 38 connects to the warm end heat exchanger 24 of the second pulse tube 14 by way of the fixed orifice 40, and the warm end of the first regenerator 16 connects to the warm end heat exchanger 24 of the second pulse tube 14 by way of the fixed orifice 42.

The term "fixed orifice" does not mean that this device is not adjustable but rather that the device if adjustable is not adjusted or varying physically during steady-state operation of the refrigerator.

These refrigerators are improved in general by reducing system losses and by increasing the work effected by gas expansion at the cold end of the pulse tube. Refrigerant gas flowing in and out of the pulse tubes at each end is controlled to affect the gas expansion work by sequenced operation of the valves 34–37. Operation of each valve in a cycle shifts the phase between the gas pressure fluctuation and the gas displacement inside the pulse tubes.

Figure 2:
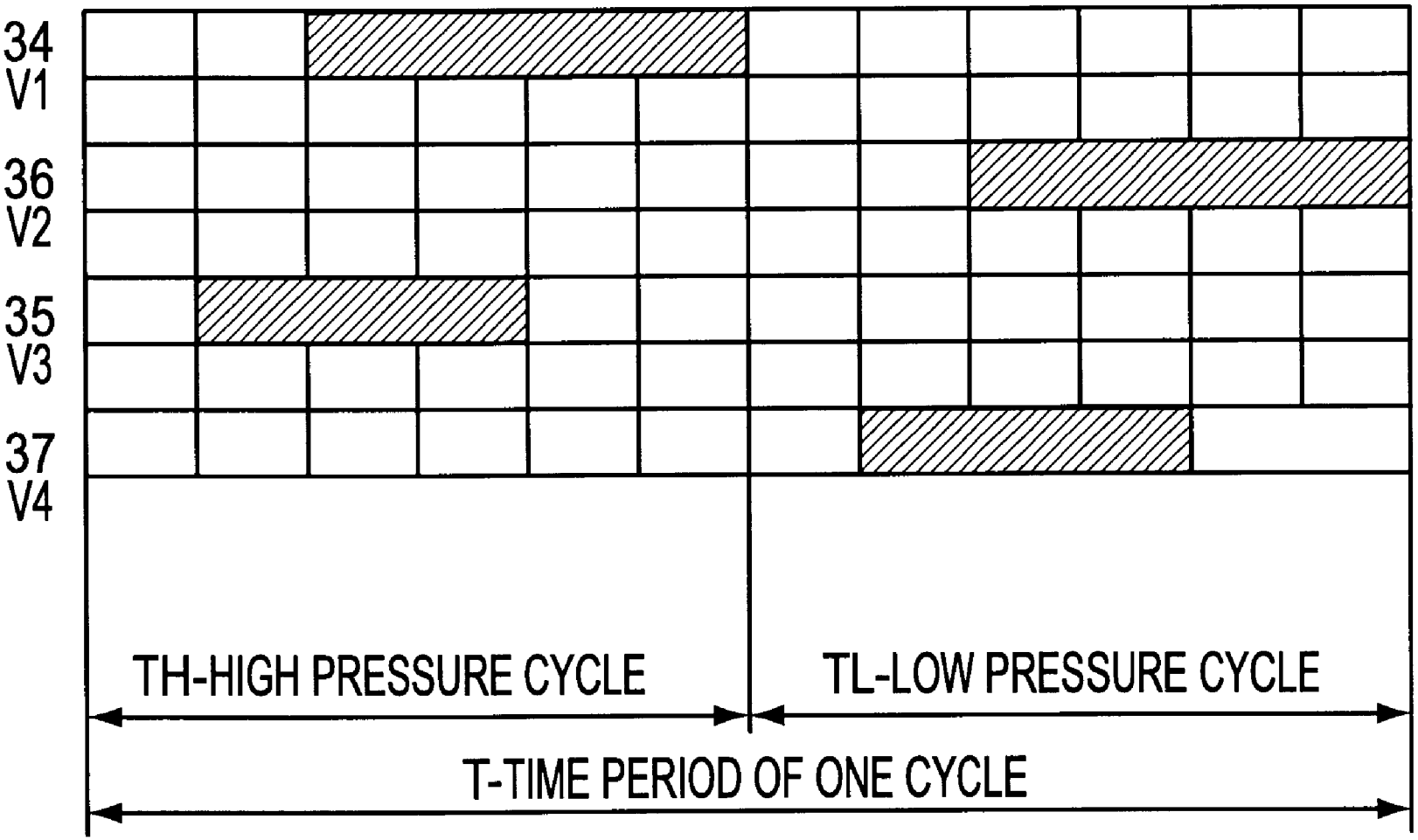
FIG. 2 is a timing graph for active valves in the refrigerator of FIG. 1.

FIG. 2 indicates the timing for each valve 34–37. That is, the crossed hatched rectangles indicate periods within a single operating cycle when the particular valve is open, permitting flow of gas therethrough. The cycle begins with each of the valves 34–37 closed and the cycle finishes in the same state.

In another embodiment of a two-stage pulse tube refrigerator in accordance with the invention (FIG. 3), the physical configuration is substantially similar to that in FIG. 1, except that a fifth on/off valve 44 has been added connecting the buffer 38 to the warm end heat exchanger of the first pulse tube 12. Similar reference numerals are used in FIG. 3 (and in all drawings), to designate the same elements that appear in several embodiments in the application.

Figure 3:
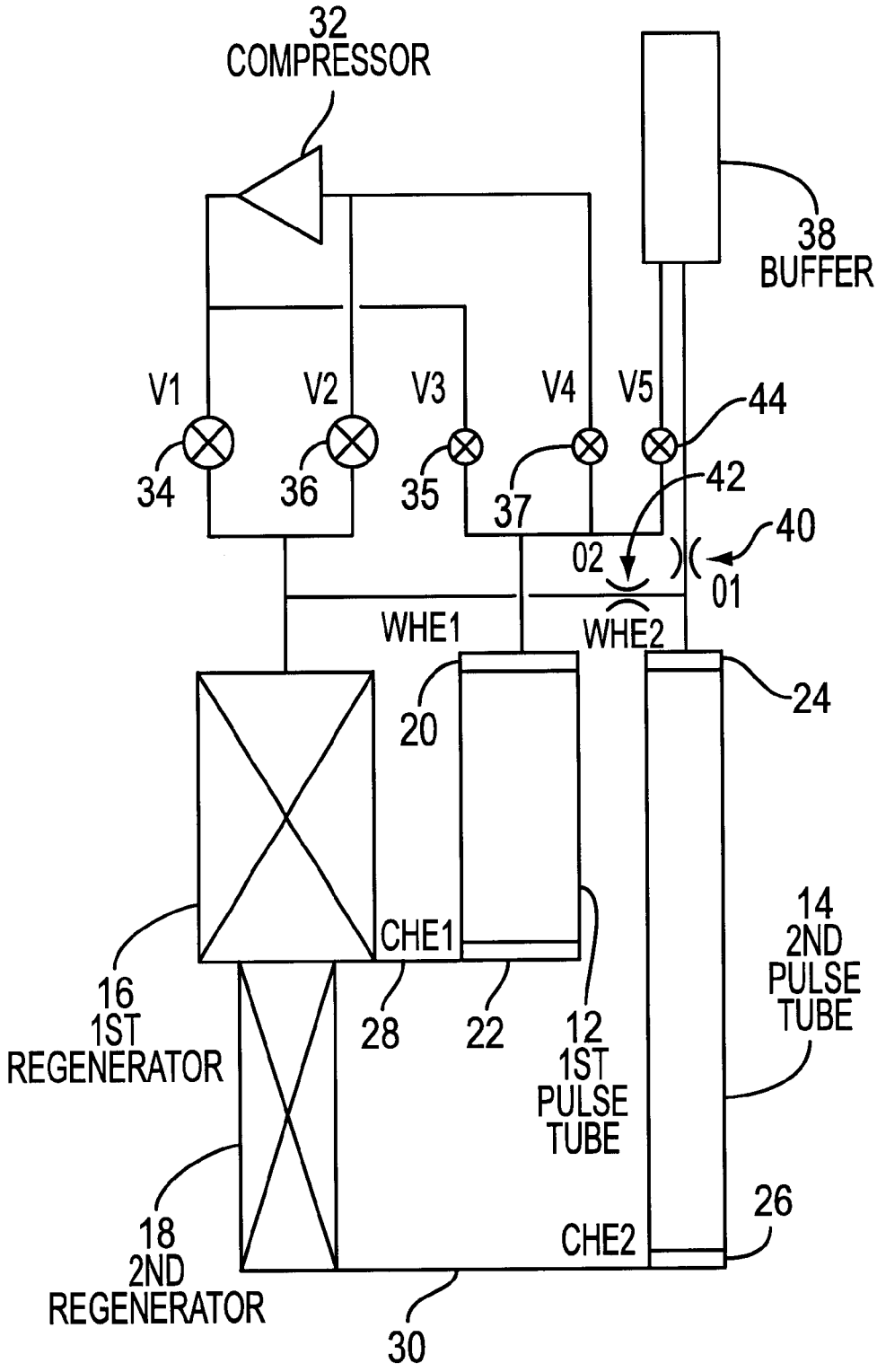
FIG. 3 is a schematic diagram of an alternative embodiment of a two-stage pulse tube refrigerator in accordance with the invention.
Figure 4:
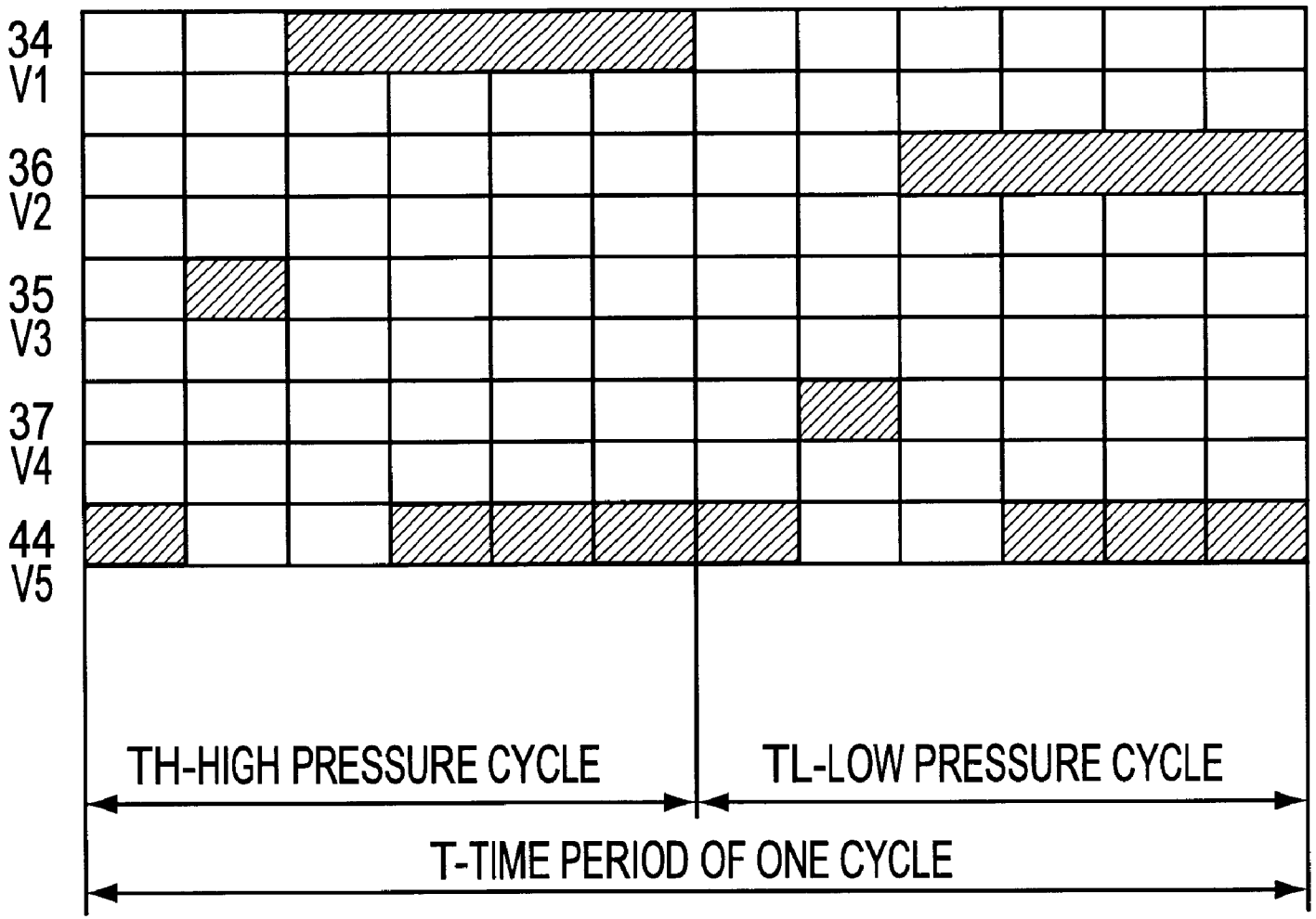
FIG. 4 is a valve timing chart associated with the embodiment of FIG. 3.

FIG. 4 illustrates the timing for opening and closing each of the valves in one cycle of the refrigerator of FIG. 3.

Figure 5:
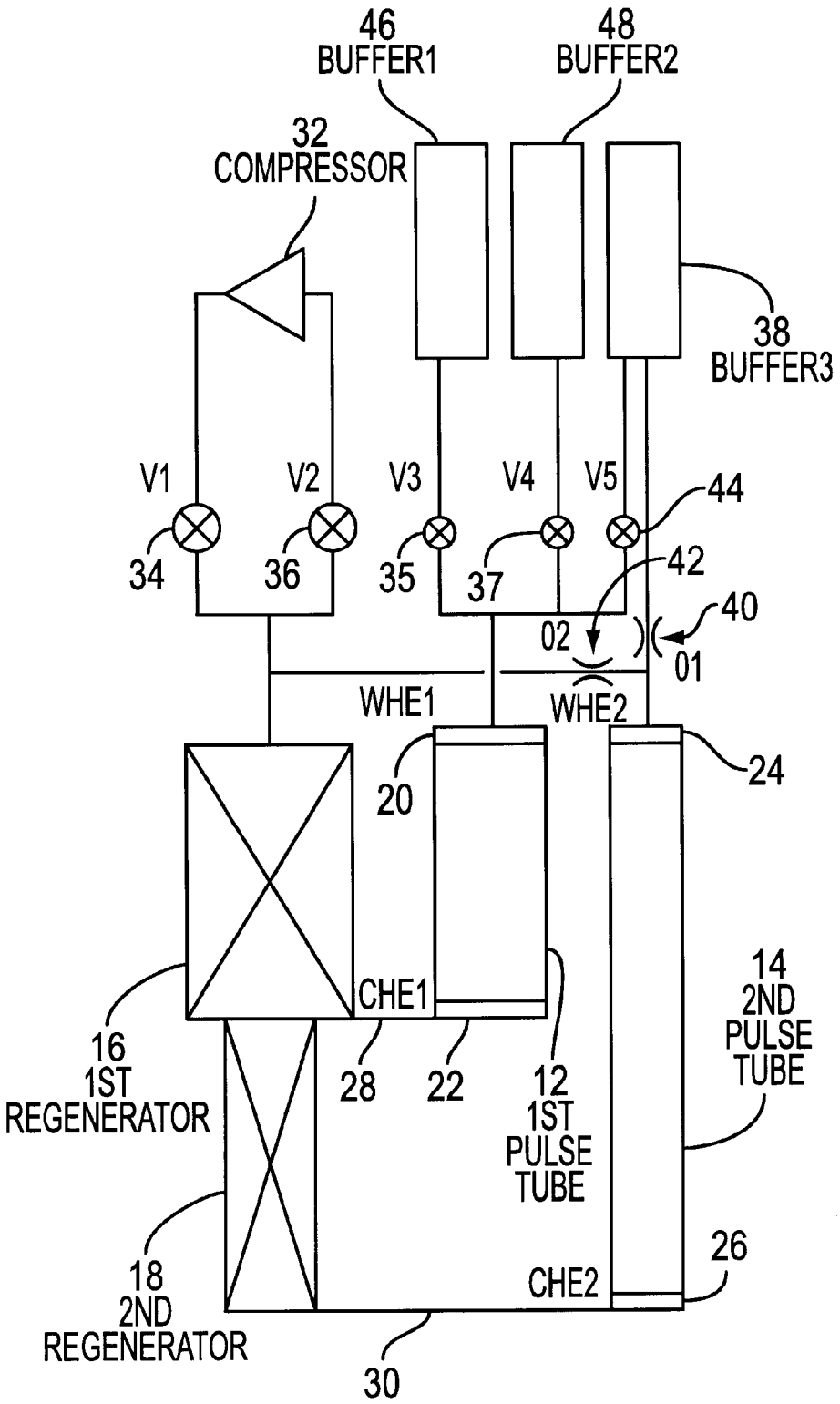
FIG. 5 is a schematic of another alternative embodiment of a two-stage pulse tube refrigerator in accordance with a the invention.
Figure 6:
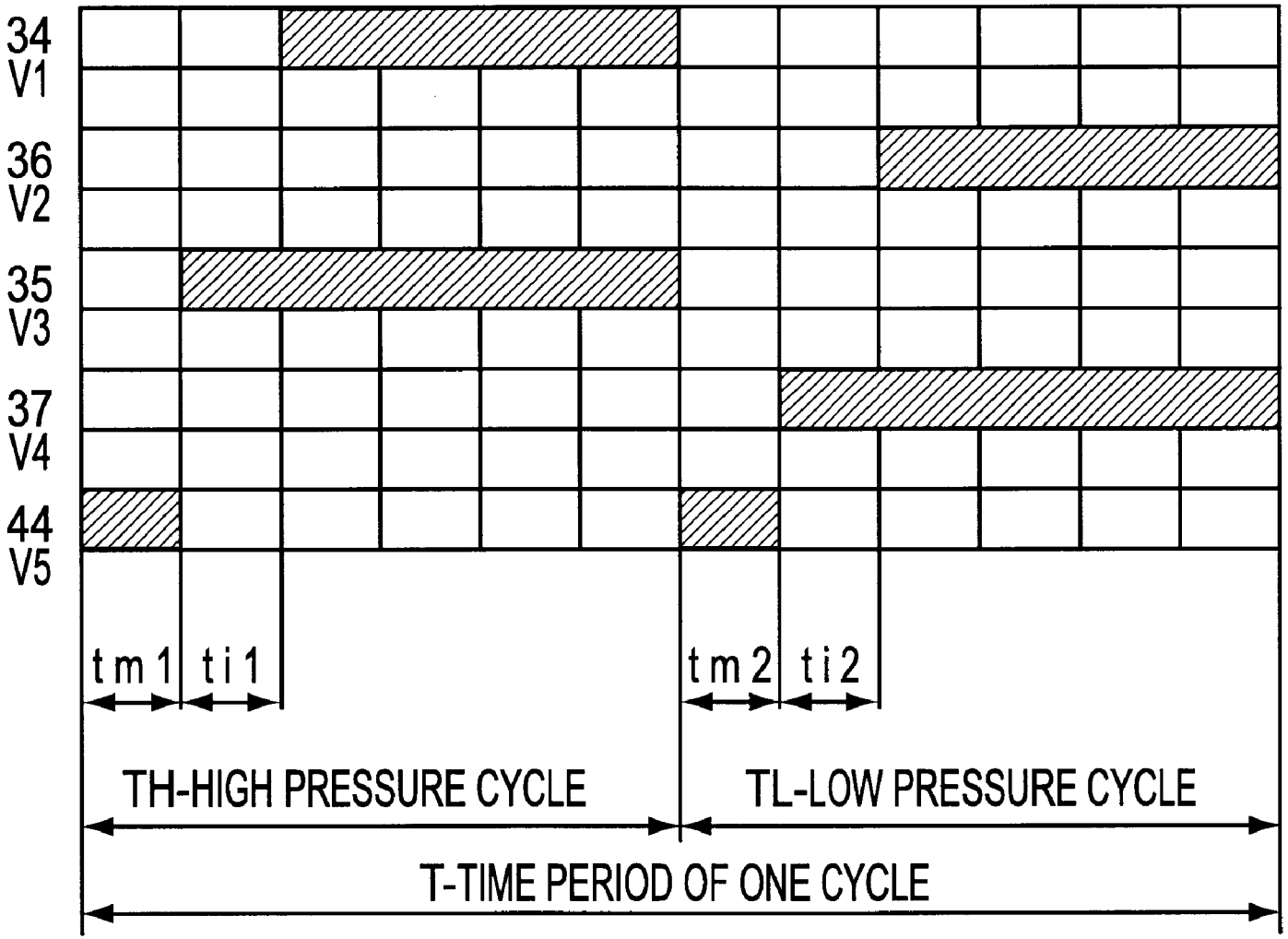
FIG. 6 is a valve timing chart associated with the embodiment of FIG. 5.

In the embodiment in accordance with the invention of FIG. 5 the connection between the compressor 32 and the warm end heat exchanger 20 of the first pulse tube 12 is replaced by additional buffers 46, 48. FIG. 6 illustrates the valve timing cycle associated with the embodiment of FIG. 5. In FIG. 5, three active valves 35, 37, 44 are positioned at room temperature between three buffers 38, 46, 48 and the warm end of the first stage pulse tube 12. FIG. 6 illustrates valve timing for a single cycle of operation.

Figure 7:
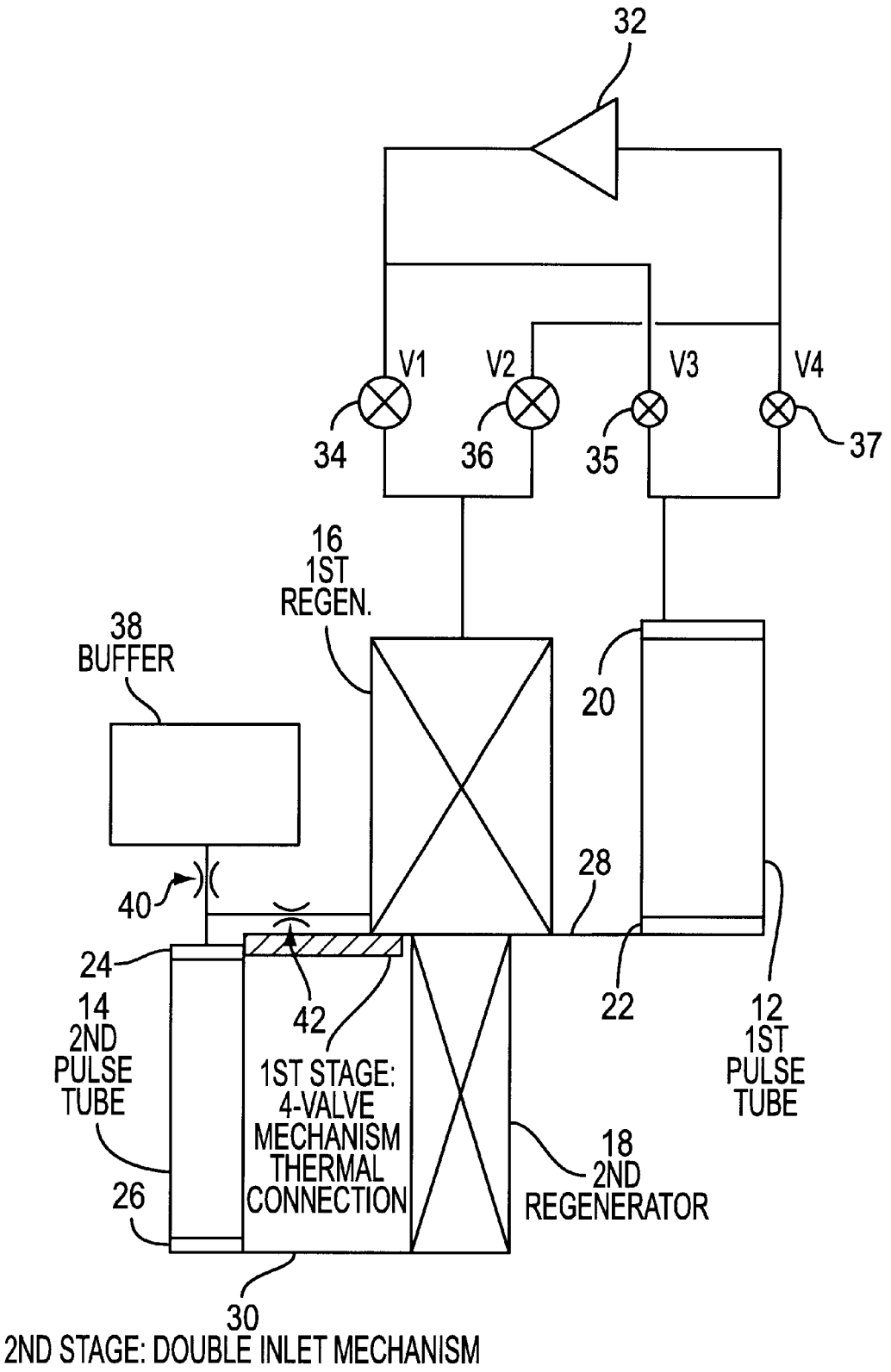
FIG. 7 is a schematic diagram of yet another alternative embodiment of a two-stage pulse tube refrigerator in accordance with the invention.

The two-stage pulse tube refrigerator of FIG. 7 is an embodiment in accordance with the invention wherein the double fixed orifice phase shifter for the second stage is thermally connected with the first stage cold end. Further, the second stage pulse tube 14 warm end is thermally connected with the first stage pulse tube 12 cold end. One orifice 42 is positioned between the first stage pulse tube 12 cold end and the second stage pulse tube 14 warm end. Another orifice 40 is positioned between the warm end of the second stage pulse tube 14 and one buffer 38 at the first stage pulse tube 12 cold end.

Figure 8:
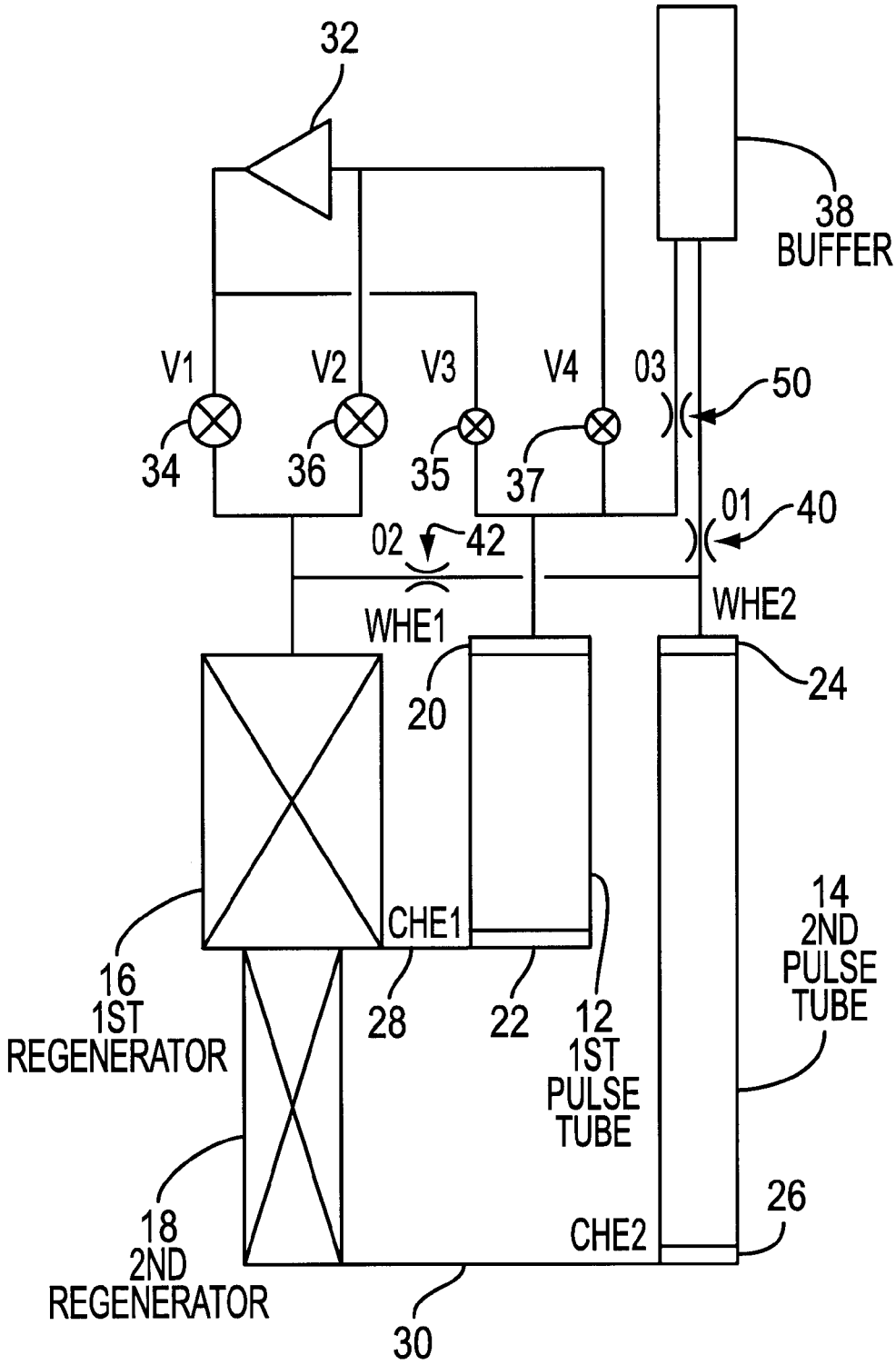
FIG. 8 is a schematic diagram of an fifth alternative embodiment of a two-stage pulse tube refrigerator in accordance with the invention.

The embodiment in accordance with the invention of FIG. 8, is similar to the embodiment of FIG. 3 except that the fixed orifice 50 in FIG. 8 replaces the valve 44 in the embodiment of FIG. 3. Valve timing is similar to FIG. 2.

Figure 9:
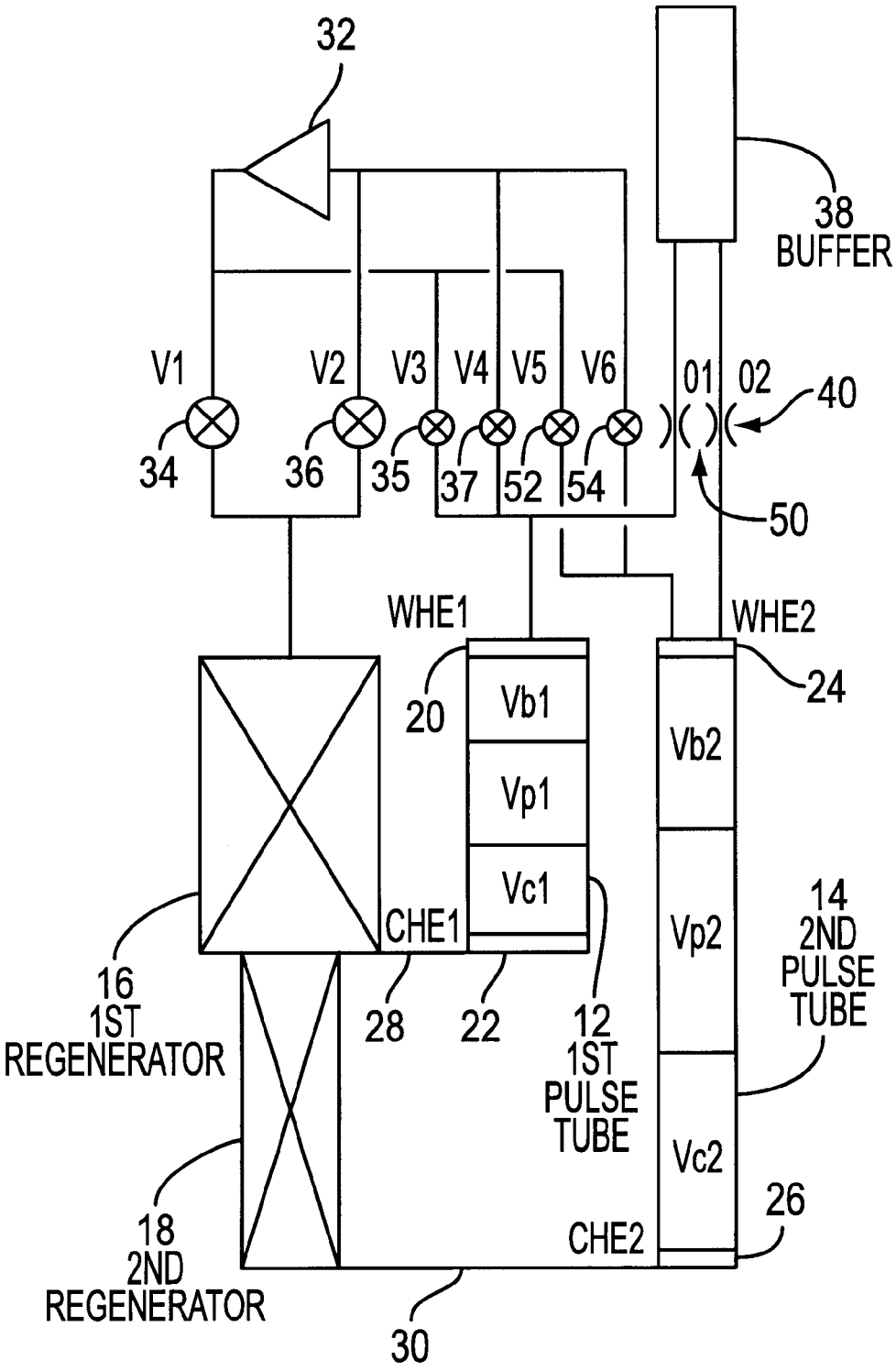
FIG. 9 is a schematic diagram of a sixth alternative embodiment of a two-stage pulse tube refrigerator in accordance with the invention.
Figure 11:
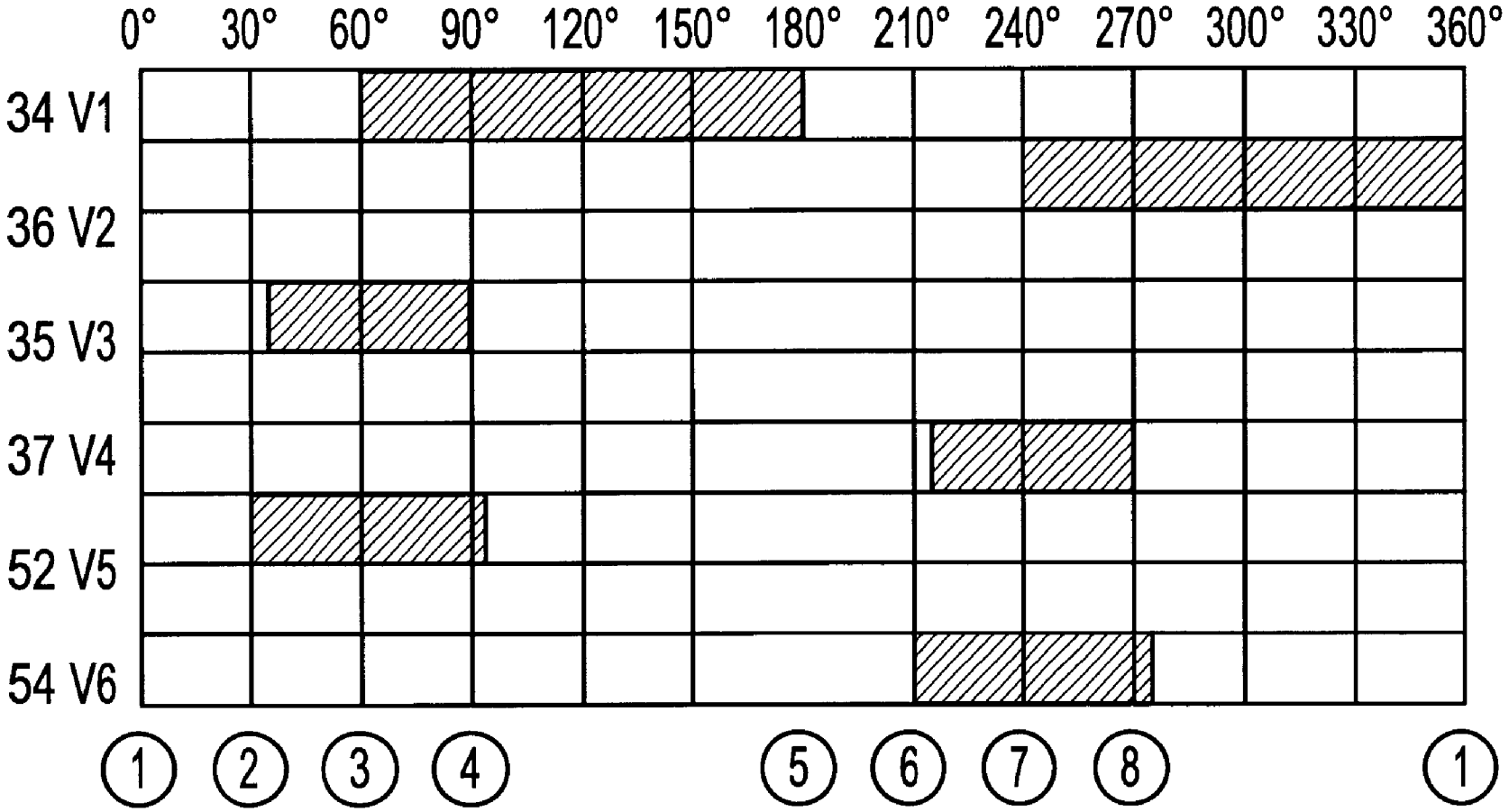
FIG. 11 is a valve timing chart associated with the embodiment of FIG. 9.

The embodiment of a two-stage pulse tube refrigerator in accordance with the invention of FIG. 9 differs from FIG. 8 in that the orifice 42 of FIG. 8 is replaced by on/off valves 52, 54 that are between the warm end heat exchanger 24 of the second pulse tube 14 and the compressor 32 inlet and discharge respectively. FIG. 11 indicates the timing sequence for the six valves in the embodiment of FIG. 9 for a single refrigeration cycle.

Operation of the two-stage pulse tube refrigerator in accordance with the invention of FIG. 9, a preferred embodiment, is now explained. For purposes of this discussion, the internal volume of the first pulse tube is divided into three parts, namely a hot volume Vh1 at the warm end of the first stage pulse tube 12, a cold volume Vc1 at the cold end of the pulse tube 12, and the intermediate volume Vp1 that is the gas piston, as will be understood by those skilled in the pulse tube arts.

Figure 10B:
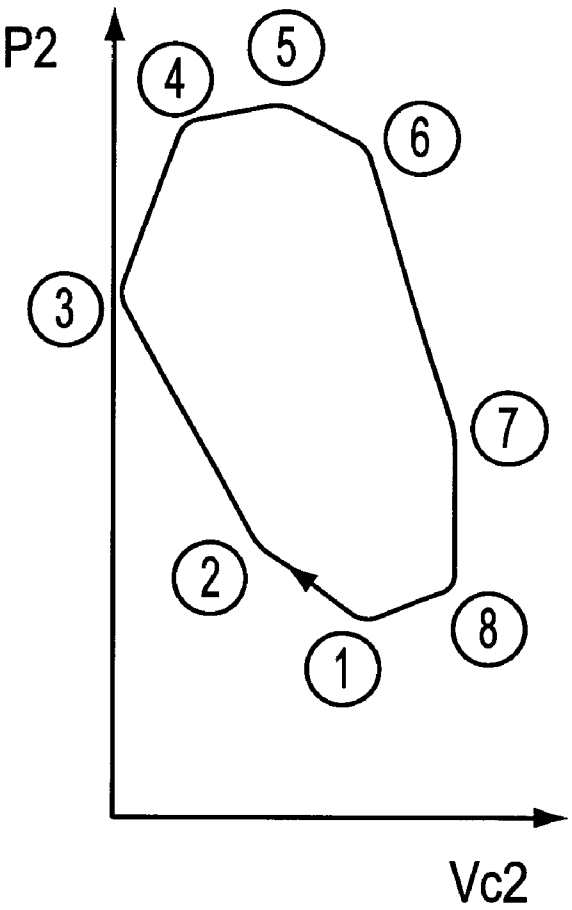
FIG. 10(*a*) and FIG. 10(*b*) are pressure-volume diagrams of gas volumes at respective cold ends of the two pulse tubes of the embodiment of FIG. 9.
Figure 10A:
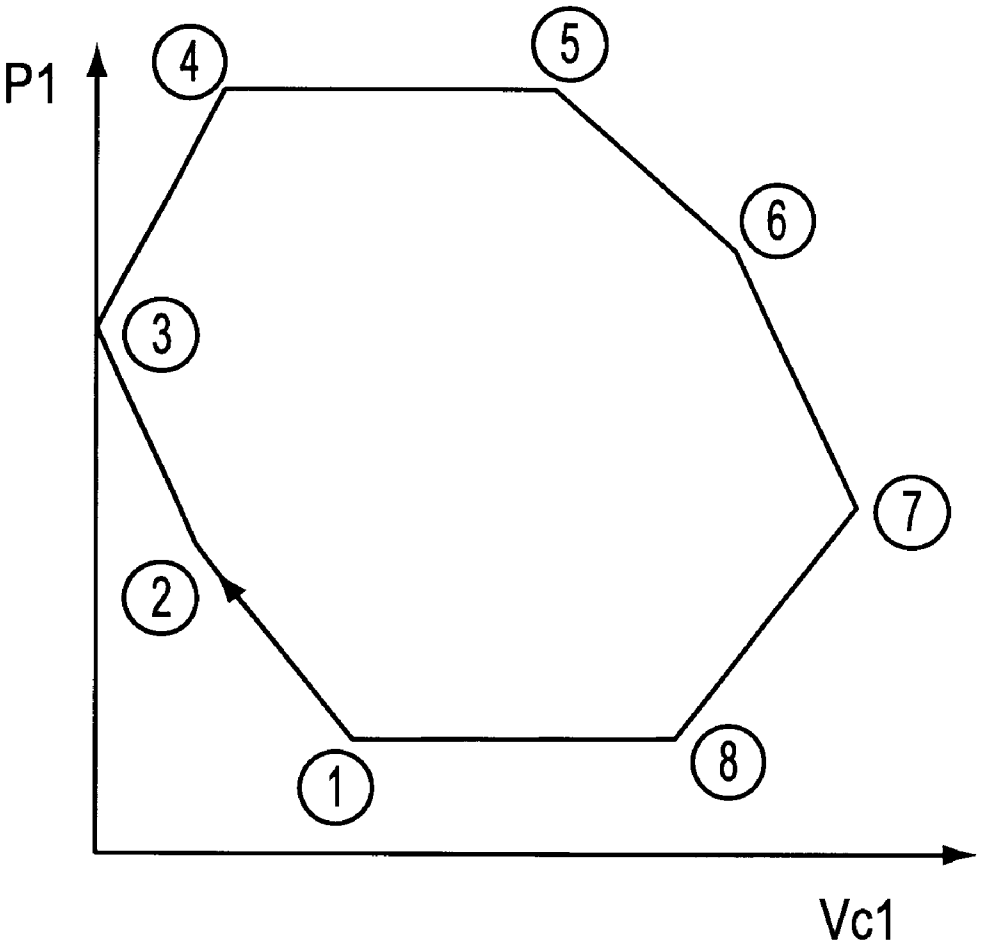

The second stage pulse tube 14 is similarly divided showing Vh2, Vc2 and the intermediate Vp2. FIG. 10*a* is a PV diagram showing changes of pressure and volume of the gas represented by Vc1 in the first stage pulse tube 12, and FIG. 10*b* is a similar PV cycle diagram for the cold gas volume Vc2 in the second stage pulse tube 14. It will be appreciated that the purpose of phase shifting is to increase the area enclosed in the PV cycle diagram. This enclosed area represents cooling capacity made available by the refrigerator.

Basic Principle of Operation for Hybrid Two-Stage Pulse Tube Refrigerator (FIG. 9)

In comparison to a G-M refrigerator, the gas within the pulse tube works as a compressible displacer (as a piston). This gas piston has to move with correct relative timing for a desired refrigeration cycle by using a phasing control mechanism located at the pulse tubes warm ends. The thermodynamic process of the hybrid two-stage pulse tube refrigerator of the present invention is described as follows:

Process 1-2: Starting at point 1 with all valves closed and the pulse tubes at low pressure, gases from the buffer flow into the pulse tubes through the orifices 50 (O1) and 40 (O2). The pressure in the pulse tubes is thereby increased and the gas pistons Vp1 and Vp2 move toward the cold ends of the pulse tubes and the volumes Vc1 and Vc2 are decreased.

Process 2-3: With gas pistons near the respective bottoms of the pulse tube cold ends, the inlet valve 52 (V5) is opened first and the valve 35 (V3) is opened later, the pressures in the pulse tubes are further increased by connection to the compressor discharge. The gas pistons move to the bottoms of the pulse tubes so that Vc1 and Vc2 are zero.

Process 3-4: With the inlet valves V5 and V3 still opened, the inlet valve V1 is opened, and the pressures in the pulse tubes are increased to high pressure. The gas pistons in the pulse tubes start to move from the cold ends toward the hot ends of the pulse tubes, and Vc1 and Vc2 increase.

Process 4-5: With the inlet valve V1 still opened, V3 is closed first and V5 is closed later. Thus, the gas piston in each pulse tube continues to move from the cold ends to the hot ends of the pulse tubes, and Vc1 and Vc2 increase at relatively constant pressure.

Process 5-6: All valves are closed and the pulse tubes have high pressure. Gases from the pulse tubes flow into the buffer through the orifices O1 and O2. The pressure in the pulse tubes is thereby decreased and the gas pistons Vp1 and Vp2 move toward the hot ends of the pulse tubes. Vc1 and Vc2 increase.

Process 6-7: With the gas pistons near the tops of the pulse tube hot ends, the outlet valve V6 is opened first and V4 is opened later, the pressures in the pulse tubes are further decreased by connection to the compressor suction. The gas pistons move to the warm tops of the pulse tubes.

Process 7-8: With the outlet valves V6 and V4 still opened, the outlet valve V2 is opened, and the pressures in the pulse tubes are decreased to low pressure. The gas pistons in the pulse tubes start to move from the hot ends toward the cold ends of the pulse tubes.

Process 8-1: With the inlet valve V2 still opened, V4 is closed first and V6 is closed later. Thus the gas piston in the pulse tube continue to move from hot ends to cold ends of the pulse tubes to complete the cycle.

Operation of the pulse tube refrigerators of FIGS. 1, 3, 5, 7, 8, are similar to the process described above when considered with their associated timing charts for valve operation, and will be readily understood by those skilled in the art.

It will thus be seen that the objects set forth above, those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limited sense.

It is also to be understood that the following claims are intended to cover all of the generic and specific features of the invention herein described, and all statements of the scope of the invention, which as a matter of language might be said to fall between there.

What is claimed is:

1. A two-stage pulse tube refrigerator for use in a cryogenic refrigeration system, comprising:

a first-stage regenerator having a warm end and a cold end;

a second-stage regenerator having a warm end and a cold end, said warm end of such second-stage regenerator connecting to said cold end of said first-stage regenerator;

a first-stage pulse tube having a warm end and a cold end, said cold end of said first-stage pulse tube being connected to said cold end of said first-stage regenerator;

a second-stage pulse tube having a warm end and a cold end, said cold end of said second-stage pulse tube being connected to said cold end of said second-stage regenerator;

a first phase controller including on/off valves and connected to said first-stage pulse tube warm end;

a second phase controller including a fixed orifice and connected to said second-stage pulse tube warm end;

connections for joining said warm end of said first-stage regenerator and said on/off valves to a refrigerant gas compressor.

2. A two-stage pulse tube refrigerator as in claim 1, further comprising said compressor having a high pressure discharge and a low pressure inlet, wherein said connections include an on/off valve V1 between said warm end of said first regenerator and said high pressure discharge of said compressor, and an on/off valve V2 between said warm end of said first regenerator and said low-pressure inlet of said compressor.

3. A two-stage pulse tube refrigerator as in claim 1, further comprising said compressor having a high pressure discharge and a low pressure inlet, wherein said first phase controller includes an on/off valve V3 between said first-stage pulse tube warm end and said high pressure discharge and an on/off valve V4 between said first-stage said pulse tube warm end and said low pressure inlet.

4. A two-stage pulse tube refrigerator as in claim 3, further comprising a first buffer, wherein said first phase controller includes an on/off valve V5 between said first-stage pulse tube warm end and said first buffer.

5. A two-stage pulse tube refrigerator as in claim 3, further comprising a second buffer, said second phase controller including a fixed orifice (O3) connected between said warm end of said first-stage pulse tube and said second buffer.

6. A two-stage pulse tube refrigerator as in claim 1, further comprising a first buffer and a second buffer, wherein said first phase controller includes a first on/off valve between said first buffer and said warm end of said first-stage pulse tube, and a second on/off valve between said second buffer and said warm end of said first-stage pulse tube.

7. A two-stage pulse tube refrigerator as in claim 6, further comprising a third buffer, said first phase controller including a third on/off valve between said third buffer and said warm end of said first-stage pulse tube.

8. A two-stage pulse tube refrigerator as in claim 1, wherein said second phase controller includes a first fixed orifice, a second fixed orifice, and a buffer, said buffer connecting to said warm end of said second stage pulse tube through said first fixed orifice, said second fixed orifice connecting said warm end of said second stage pulse tube to said warm end of said first regenerator.

9. A two-stage pulse tube refrigerator as in claim 1, further comprising a refrigerant compressor having a high pressure discharge and a low pressure inlet, and a buffer, wherein said second phase controller includes a fixed orifice connecting said buffer to said warm end of said second stage pulse tube, and two on/off valves connecting between said discharge and inlet respectively of said compressor and said second stage pulse tube warm end.

10. A two-stage pulse tube refrigerator as in claim 1, wherein said warm end of said second stage pulse tube and said second phase controller are located at room temperature.

11. A two-stage pulse tube refrigerator as in claim 1, wherein said warm end of said second stage pulse tube and said second phase controller are thermally connected with said first stage pulse tube cold end and said first stage regenerator cold end.

12. A two-stage pulse tube refrigerator as in claim 1, further comprising a plurality of heat exchangers, a heat exchanger being located respectively at each end of said first stage and second stage pulse tubes.

13. A two-stage pulse tube refrigerator as in claim 1, further comprising a refrigerant compressor having a high pressure discharge and a low pressure inlet, wherein said first phase controller includes two on/off valves connected to said warm end of said first stage pulse tube, said two on/off valves connected to said compressor discharge and inlet, said second phase controller includes two fixed orifices, each said orifice connected at one end to said warm end of said second stage pulse tube, one said orifice at its other end connected to said warm end of said first stage regenerator, and an other end of said other orifice being connected to a buffer.

14. A two-stage pulse tube refrigerator as in claim 13, further comprising an on/off valve connected between said buffer and said warm end of said first stage pulse tube.

15. A two-stage pulse tube refrigerator for use in a cryogenic refrigeration system comprising:

a refrigerant compressor having a high pressure discharge and a low pressure inlet;

a first-stage regenerator having a warm end and a cold end;

a second-stage regenerator having a warm end and a cold end, said warm end of such second-stage regenerator connecting to said cold end of said first-stage regenerator;

a first-stage pulse tube having a warm end and a cold end, said cold end of said first-stage pulse tube being connected to said cold end of said first-stage regenerator;

a second-stage pulse tube having a warm end and a cold end, said cold end of said second-stage pulse tube being connected to said cold end of said second-stage regenerator;

two on/off valves connected to said warm end of said first stage regenerator and said compressor discharge and inlet;

a plurality of buffers and an equal plurality of on/off valves respectively connecting said buffers to said warm end of said first stage pulse tube;

one buffer of said plurality of buffers being connected to said warm end of said second stage pulse tube with a first fixed orifice;

a second fixed orifice connecting between said warm end of said second stage pulse tube and said warm end of said first regenerator.

16. A two-stage pulse tube refrigerator as in claim 1, further comprising a compressor having a high pressure discharge and a low pressure inlet;

wherein said fixed orifice connected to said second stage pulse tube warm end connects said second stage pulse tube to a buffer, a second fixed orifice connects said second stage pulse tube warm end to said cold end of said first regenerator;

said connections for joining said warm end of said first stage regenerator to said refrigerant gas compressor being a pair of on/off valves respectively connected to said discharge and inlet of said compressor;

a second pair of on/off valves connecting respectively to said compressor discharge and inlet and to said warm end of said first stage pulse tube.

17. A two-stage pulse tube refrigerator for use in a cryogenic refrigeration system, comprising:

a refrigerant compressor having a high pressure discharge and a low pressure inlet;

a first-stage regenerator having a warm end and a cold end;

a second-stage regenerator having a warm end and a cold end, said warm end of such second-stage regenerator connecting to said cold end of said first-stage regenerator;

a first-stage pulse tube having a warm end and a cold end, said cold end of said first-stage pulse tube being connected to said cold end of said first-stage regenerator;

a second-stage pulse tube having a warm end and a cold end, said cold end of said second-stage pulse tube being connected to said cold end of said second-stage regenerator;

a first phase controller including a pair of on/off valves connected between said first-stage pulse tube warm end and said high pressure discharge and low pressure inlet respectively, and another pair of on/off valves connected between said warm end of said first stage regenerator and said compressor discharge and inlet;

a second phase controller including two fixed orifices and a buffer, said buffer connecting to said warm end of said second stage pulse tube through one of said two fixed orifices, the other of said two orifices connecting said warm ends of said first stage regenerator and said second stage pulse tube;

a third fixed orifice connecting said buffer to said first stage pulse tube warm end.

18. A two-stage pulse tube refrigerator for use in a cryogenic refrigeration system, comprising:

a refrigerant compressor having a high pressure discharge and a low pressure inlet;

a first-stage regenerator having a warm end and a cold end;

a second-stage regenerator having a warm end and a cold end, said warm end of such second-stage regenerator connecting to said cold end of said first-stage regenerator;

a first-stage pulse tube having a warm end and a cold end, said cold end of said first-stage pulse tube being connected to said cold end of said first-stage regenerator;

a second-stage pulse tube having a warm end and a cold end, said cold end of said second-stage pulse tube being connected to said cold end of said second-stage regenerator;

a first pair of on/off valves connected between said first-stage pulse tube warm end and said high pressure discharge and low pressure inlet respectively, and a second pair of on/off valves connected between said warm end of said first stage regenerator and said compressor discharge and inlet respectively, and a third pair of on/off valves connected between said warm end of said second stage pulse tube and said compressor discharge and inlet respectively;

two fixed orifices and a buffer, said buffer connecting to said warm end of said second stage pulse tube through one of said two fixed orifices, the other of said two orifices connecting to said warm end of said first stage pulse tube.

19. A two-stage pulse tube refrigerator as in claim 13, further comprising a plurality of heat exchangers, a heat exchanger being located respectively at each end of said first stage and second stage pulse tubes.

20. A two-stage pulse tube refrigerator as in claim 14, further comprising a plurality of heat exchangers, a heat exchanger being located respectively at each end of said first stage and second stage pulse tubes.

21. A two-stage pulse tube refrigerator as in claim 15, further comprising a plurality of heat exchangers, a heat exchanger being located respectively at each end of said first stage and second stage pulse tubes.

22. A two-stage pulse tube refrigerator as in claim 16, further comprising a plurality of heat exchangers, a heat exchanger being located respectively at each end of said first stage and second stage pulse tubes.

23. A two-stage pulse tube refrigerator as in claim 17, further comprising a plurality of heat exchangers, a heat exchanger being located respectively at each end of said first stage and second stage pulse tubes.

24. A two-stage pulse tube refrigerator as in claim 18, further comprising a plurality of heat exchangers, a heat exchanger being located respectively at each end of said first stage and second stage pulse tubes.

* * * * *